United States Patent [19]

Cornellier

[11] 4,411,294

[45] Oct. 25, 1983

[54] METHOD AND APPARATUS FOR INSERTING WEFT FILAMENTS

[76] Inventor: Joseph R. Cornellier, P.O. Box 383, Station K, Montreal, Quebec, Canada

[21] Appl. No.: 919,177

[22] Filed: Jun. 26, 1978

Related U.S. Application Data

[63] Continuation-in-part of Ser. No. 786,597, Apr. 11, 1977, Pat. No. 4,134,435.

[30] Foreign Application Priority Data

Mar. 15, 1977 [CA] Canada ..... 273991

[51] Int. Cl.[3] ..... D03D 47/32

[52] U.S. Cl. ..... 139/435

[58] Field of Search ..... 139/429, 435

[56] References Cited

U.S. PATENT DOCUMENTS

| | | | |
|---|---|---|---|
| 1,368,691 | 2/1921 | Brooks | 139/435 |
| 1,386,550 | 8/1921 | Brooks | 139/435 |
| 3,519,030 | 7/1970 | Vermeulen | 139/435 |
| 3,782,422 | 1/1974 | Vermeulen | 139/435 |
| 3,828,829 | 8/1974 | Gotoh et al. | 139/435 |
| 3,977,442 | 8/1976 | Shibata et al. | 139/435 |
| 4,074,727 | 2/1978 | Kwok et al. | 139/435 |

FOREIGN PATENT DOCUMENTS

| | | | |
|---|---|---|---|
| 206419 | 5/1972 | U.S.S.R. | 139/435 |

*Primary Examiner*—Henry Jaudon
*Attorney, Agent, or Firm*—Lawrence I. Field

[57] ABSTRACT

There are provided improvements relating to liquid jet looms in which one improvement relates to the conversion of conventional shuttle looms to liquid jet looms; in another improvement, there is provided a storage device for retaining a length of weft filament in which the storage device is in the form of an open-top chamber with a pair of open ends between closed side walls with the closed side walls having an open top providing access to a cavity formed by the side walls. In a still further improvement, there is provided a method and apparatus for advancing a weft filament across a shed of a loom in which the filament is advanced by engaging a stream of liquid but in which the flow of liquid is interrupted prior to the filament traversing the width of the shed.

7 Claims, 7 Drawing Figures

METHOD AND APPARATUS FOR INSERTING WEFT FILAMENTS

This application is a continuation-in-part of copending U.S. patent application No. 786,597, filed Apr. 11, 1977, now U.S. Pat. No. 4,134,435.

This invention relates to improvements in fluid or liquid jet looms.

More particularly, this invention relates to improvements relating to such liquid jet looms as are commonly known as water jet looms, which improvements relate to the weft filament or yarn storage devices for use in such looms; in a further embodiment, this invention relates to improvements in means for feeding and advancing a length of weft filament or yarn across the shed of liquid jet looms; and in a further embodiment, this invention relates to improvements in means for actuating the feeding of weft filaments or yarns for insertion into the shed of warp filaments.

In recent years, improvements in loom constructions have centered on the so-called "fluid" looms in place of the conventional shuttle type looms; such liquid jet looms normally employ a stream of liquid such as water to propel a length of weft filament across the warp shed in place of the conventional shuttle. There are several advantages of fluid jet looms over conventional shuttle type looms including, for example, alleged higher speeds of operation; simplified equipment for certain areas of the operation of the loom; and alleged higher reliability of the equipment.

Typical examples of the fluid jet looms are shown in Canadian Pat. No. 889,667, issued Jan. 4, 1972, and entitled "WEFT YARN MEASURING AND DETAINING DEVICE FOR SHUTTLELESS LOOM;" and Canadian Pat. No. 972,257, issued Aug. 5, 1975, and entitled "WEFT SELECTOR MECHANISM OF A FLUID JET LOOM."

In the above examples, and in the art in general, the effort on developing fluid jet looms for commercialization has centered around the manufacture and construction of new loom devices as replacements for existing shuttle looms when the latter are worn out or for manufacturers who acquire new machinery to add to their manufacturing lines. To the applicant's knowledge, no effort has been made to provide conversion equipment suitable for converting existing shuttle type looms into liquid looms in any satisfactory manner and thus, a manufacturer of woven materials in order to gain benefit from the advantages of fluid jet looms, must purchase new equipment, at a higher cost, compared to the conversion of existing looms. Moreover, in introducing a completely new structure based on the liquid jet loom principle, many different proposals have been made in the art for the feeding of the weft filament or yarn into and across the shed. The feeding of weft filament essentially relates to the basic difference between the shuttle type conventional looms and the newer liquid jet looms, and the proposals thus far developed include single or multiple sequential feeding of the weft filament through various techniques. Generally, these have relied on pneumatic or electrical components in the systems; a typical example of a recently developed weft inserting device utilizing electrical components employs a solenoid valve controlled by a pulse modifier circuit. However, one difficulty with such a device is the sensitivity of electrical components to high humidity, which is a typical factor in the weaving industry where the high humidity is used for the purpose of thread lubrication and elimination of static problems.

In terms of reliability requirements, solenoid valves and similar electrical components have not been generally acceptable in the weaving industry because of their reliability which has not been as good as the conventional shuttle type loom; and further, in general terms, electrical components such as solenoid valves do not have the length of life that typical mechanical components employed in the shuttle type loom usually have.

Still further, in the utilization of liquid jet looms as opposed to conventional shuttle type looms, due to the higher speed of operation normally associated with the former, more precise components must be employed, particularly for any adjustment means or device that is required in the timing and duration of a liquid system. Such liquid systems are known to require precise adjustments for the various components associated with the weft filament insertion devices. By way of example, one difficulty with regard to critical adjustment in the known liquid jet looms relates to the precise adjustments required for the gripping device for the weft filament—the latter device being employed for the purpose of releasing a predetermined length of weft filament for insertion into a warp shed and it has been proposed to provide a gripping device which is controlled by a rotating cam mounted on or operatively associated with the drive shaft of the liquid jet loom system. In operation, problems have arisen relative to the duration of the release time of the gripping device, which as will be appreciated, is precisely determined by the given configuration of the cam utilized in such an arrangement—and any variation from it will cause a lowering of the quality of the fabric being produced.

A still further problem associated with known types of fluid or liquid jet looms relates to the type of storage device used for storing a length of weft filament prior to insertion into the warp shed. As explained hereinafter, the storage device becomes quite critical in liquid jet looms and various proposals have been made in the prior art for providing improved storage devices overcoming the disadvantages of known structures.

Still further, in the type of prior art in which liquid lay down of the weft filament has been employed or attempted, a major problem plaguing the technology is the fact that the weft filament is extremely difficult to lay down in a straight line across the shed. Thus, in known systems, where a continuous supply of liquid such as water is used to feed the filament across the shed, the filament tends to become tangled or does not lay down in a straight manner due to the fact that the leading portion of the water stream, encountering air resistance, tends to "stack up" the portions of the liquid stream behind it with the consequence that the filament, entrained in the stream, is coiled or deviated from its straight path. Also, such problems, although attempts have been made to solve them in the past, have involved the use of much more complicated equipment which is generally quite expensive. Thus, the situation occurs where expensive equipment with supplemental valves, supplemental feed streams, etc., are employed to attempt to alleviate the problem.

The present invention overcomes the above problems as will be evidenced hereinafter, and provides a very simple and economical expedient for laying down a weft filament in a substantially straight manner.

With this invention, there is thus provided an apparatus for advancing a weft filament, in a weaving apparatus, across warp filaments comprising a source of pressurized liquid, nozzle means for projecting said source of pressurized liquid in a stream across said shed, means for supplying a length of weft filament having a free leading end and in operative relationship to said source of pressurized liquid, whereby said stream of pressurized liquid is adapted to engage said leading end of said filament, means for actuating said source of pressurized liquid to provide a predetermined amount of pressurized liquid in the form of a stream directed across a shed, and means for interrupting the flow of said stream of pressurized liquid before said weft filament traverses the width of the shed.

Operating in conjunction with the above apparatus there may be employed a gripping assembly for feeding of a weft filament to a warp shed which, in a preferred form, comprises first fixed means forming a fixed non-movable surface, second movable means mounted in operative relationship to said first fixed means whereby said second movable means is adapted to be brought into and out of filament engaging relationship with said first fixed means with said first and second means together forming a filament engaging and gripping member, and means for causing said second movable means to be brought into and out of engagement with said first fixed means, said last-mentioned means comprising a liquid inlet port adapted to receive and transmit a flow of liquid therethrough, a liquid outlet port in communication with said inlet port through a passageway between said inlet and outlet ports, and means for intermittently introducing a flow of liquid into said inlet port, whereby said flow of liquid is effective to actuate said second movable means into a filament engaging means.

The gripper assembly may also be operated in conjunction with a check-valve or the like, adapted to prevent backflow of the liquid through the system. Thus, any suitable valve means for this purpose may be employed—such valve means being located upstream of the inlet port of the gripping assembly.

A still further embodiment of the present invention relates to a weft filament storage device for a fluid jet loom in which the storage device comprises an elongated storage chamber having a pair of closed side walls interconnected by means of a closed bottom wall forming therebetween an elongated weft filament storage cavity, said chamber having a pair of open ends between said closed side walls, with said closed side walls having an open top providing access to said cavity, one of said pair of open ends being adapted to receive a loop of weft filament projected therein by means of a pneumatic jet.

In a preferred form, the storage device is adapted to operate in conjunction with a nozzle for dispersing a jet of air into said storage device, and an eyelet through which a weft filament is adapted to be fed into the storage device from a source thereof, said storage device having a maximum width between said closed side walls of 10 times the diameter of the eyelet. Preferably, the storage device has a maximum width of between 4 to 10 times the diameter of the eyelet and the side walls have a length of less than about 50% of the length of filament to be stored in the storage device.

In a still further embodiment of the present invention, there is provided a method of advancing a weft filament in a weaving operation across the warp filaments comprising the steps of providing a source of pressurized liquid, providing a length of weft filament having a free leading end, and having a predetermined amount of said pressurized liquid into a stream, said stream having a leading end engaging the free leading end of said weft filament with said leading end of said stream of pressurized liquid, directing said stream between the opposed warp filaments, and interrupting the flow of said stream of pressurized liquid before said weft filament traverses the width of the warp filaments, said predetermined amount of pressurized liquid being sufficient to pull the length of weft filament across the width of the warp filaments after the flow of said pressurized liquid is interrupted prior to said weft filament traversing the width of the warp filaments.

In the above method, preferably the predetermined amount of pressurized liquid is interrupted at between about 30 to 80%, and more preferably 25 to 60%, of the length of travel of the leading end of the weft filament across the width of the warp filaments. Still further, preferably the weft filament comprises a continuous length of filamentary material and the method includes the further step of severing, from said continuous length of filamentary material, a length of weft filament greater than the width of the warp filaments after said filament has substantially traversed the width of the warp filaments.

In a still further embodiment of this invention, there is provided an apparatus for advancing a weft filament, in a weaving apparatus, across warp filaments comprising a source of pressurized liquid, nozzle means for projecting said source of pressurized liquid in a stream across said shed, means for supplying a length of weft filament having a free leading end and in operative relationship to said source of pressurized liquid, whereby said stream of pressurized liquid is adapted to engage said leading end of said filament, means for actuating said source of pressurized liquid to provide a predetermined amount of pressurized liquid in the form of a stream directed across a shed, and means for interrupting the flow of said stream of pressurized liquid before said weft filament traverses the width of the shed.

Still further, there is provided a method of converting conventional weaving looms which includes filling components, pick motion components, parallel motion components, filling motion components and lay motion components, comprising the steps of removing from said conventional apparatus said filling system, said pick motion components, said parallel motion components, said filling motion components and said lay motion components, mounting to said apparatus a liquid jet system, said liquid jet system comprising means for advancing a weft filament across warp filaments comprising a source of pressurized liquid, nozzle means for projecting said source of pressurized liquid in a stream across said shed, means for supplying a length of weft filament having a free leading end and in operative relationship to said source of pressurized liquid whereby said stream of pressurized liquid is adapted to engage said leading end of said filament, means for actuating said source of pressurized liquid to provide a predetermined amount of pressurized liquid in the form of a stream directed across a shed, and means for interrupting the flow of said stream of pressurized liquid before said weft filament traverses the width of the shed, providing a storage chamber for said weft filament and providing means for operating said liquid jet system in conjunction with the modified loom.

In the above structure, the means for intermittently introducing a flow of liquid to the device may comprise any suitable source of liquid under pressure, and valve means for permitting introduction of the liquid to the inlet port. Typically, this may be any suitable valve such as a "one-way" trip valve—however, similar or equivalent devices may be employed for this purpose. The source of pressurized liquid is preferably common to the source of liquid used in the weft filament feeding system of the present invention, as described hereinafter—however, a separate source may be employed operating in conjunction with the feeding system if desired. It is most advantageous to use a common source of pressurized liquid for all systems of the present invention for simultaneous actuation of the various components of the overall system—and in addition, a single pressurized liquid system simplifies the number of components required compared to 2 or more systems being employed.

Actuation of the valve means for permitting intermittent flow of liquid through the system to actuate the gripping mechanism is carried out in conjunction with movement of the loom—and the actuation means is preferably of a mechanical nature tied in with the movement of the reed arm of the loom. To this end, a preferred embodiment comprises mechanical actuation means in the form of cooperating components associated with the movement of the reed arm and with the valve for providing intermittent liquid flow through the gripping system.

Having thus generally described the invention, reference will now be made to the accompanying drawings, describing preferred embodiments, and in which.

Figure 6:
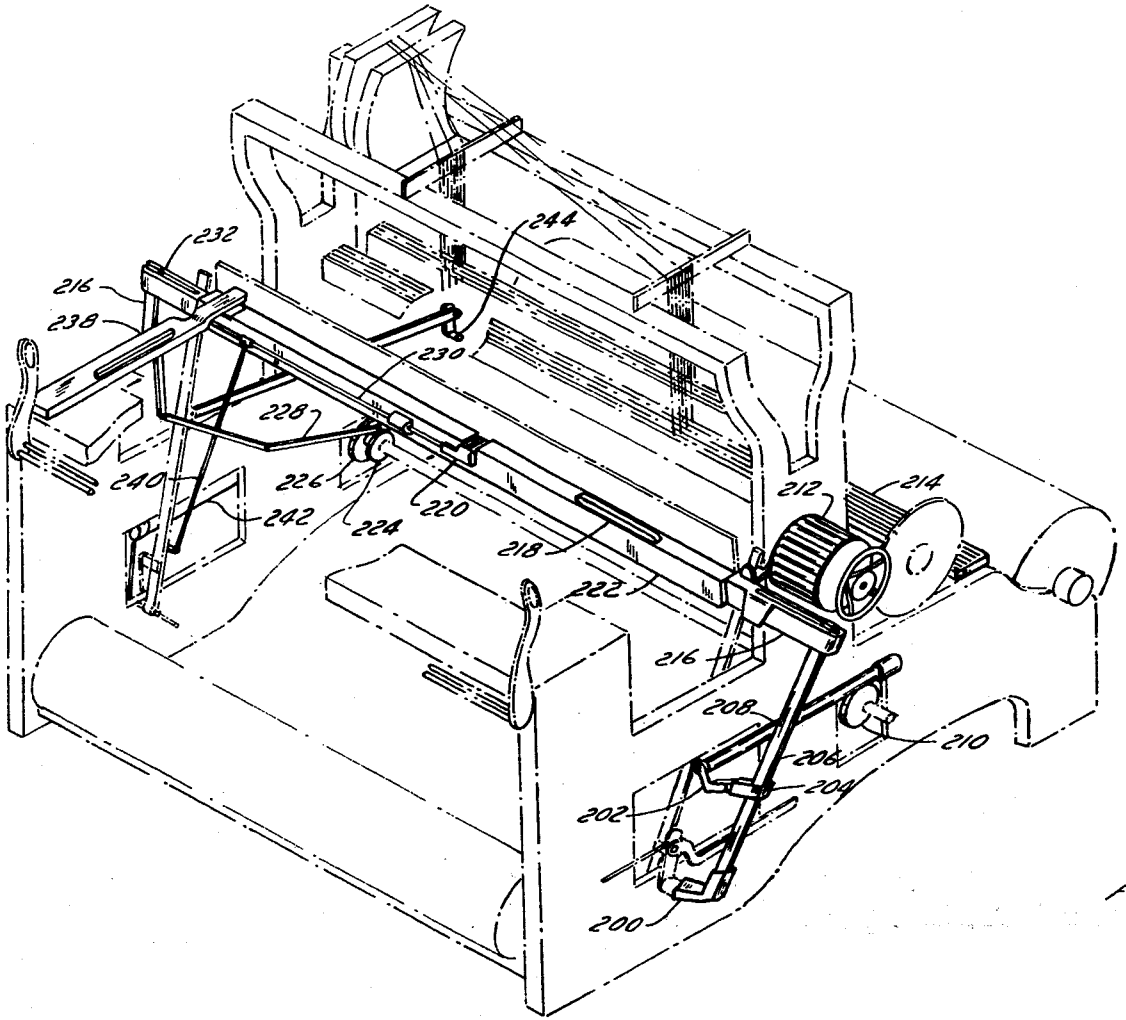
Figure 7:
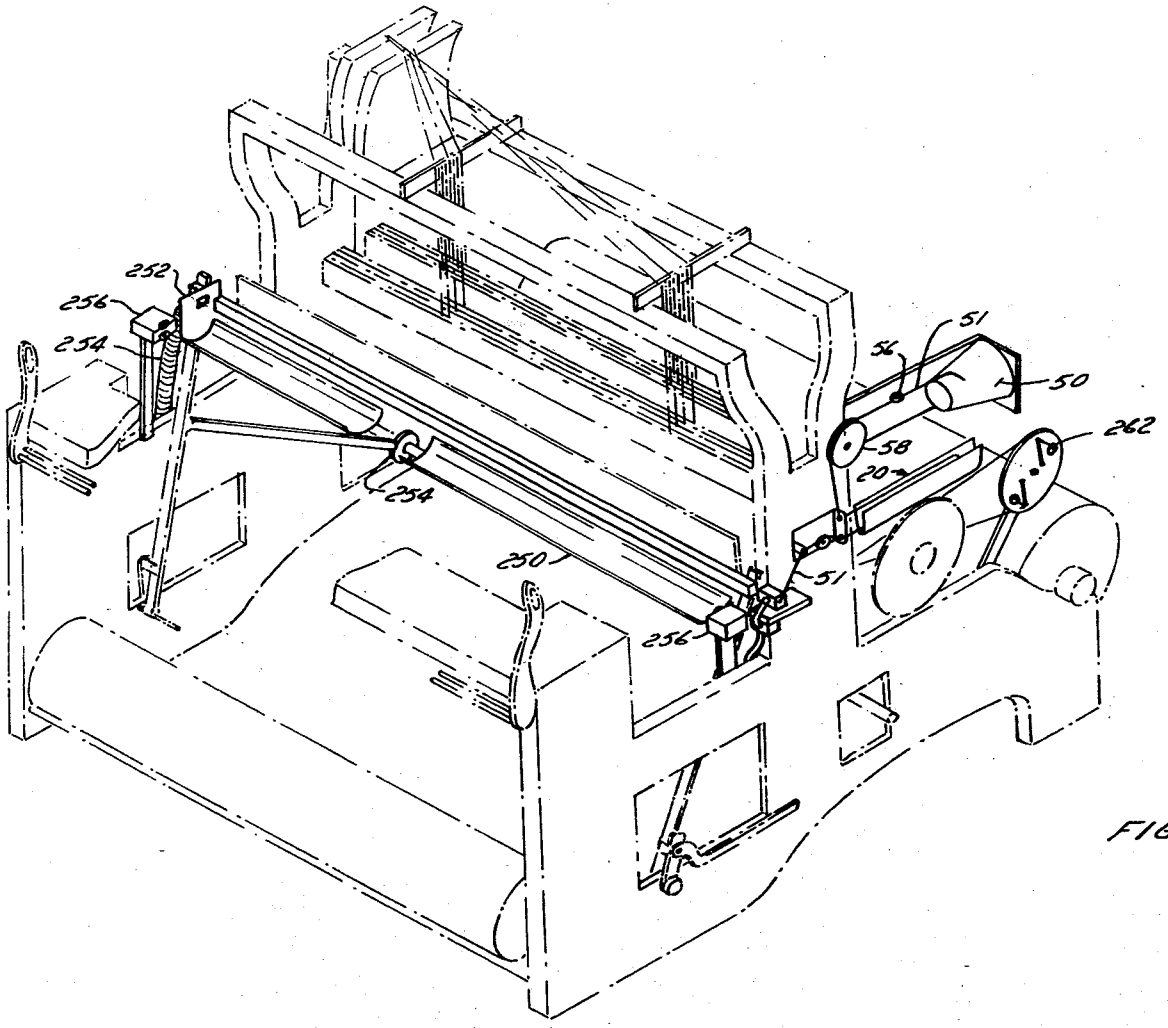

FIG. 6 is a perspective view of a typical or conventional loom showing, according to a further embodiment of the invention, the components which are removed (in solid lines) to permit modification of the same to a modified water jet loom of the present invention; and FIG. 7 is a similar view to FIG. 6 of the same loom showing the modified loom with the components incorporated therein according to a further embodiment of the present invention.

Figure 1:
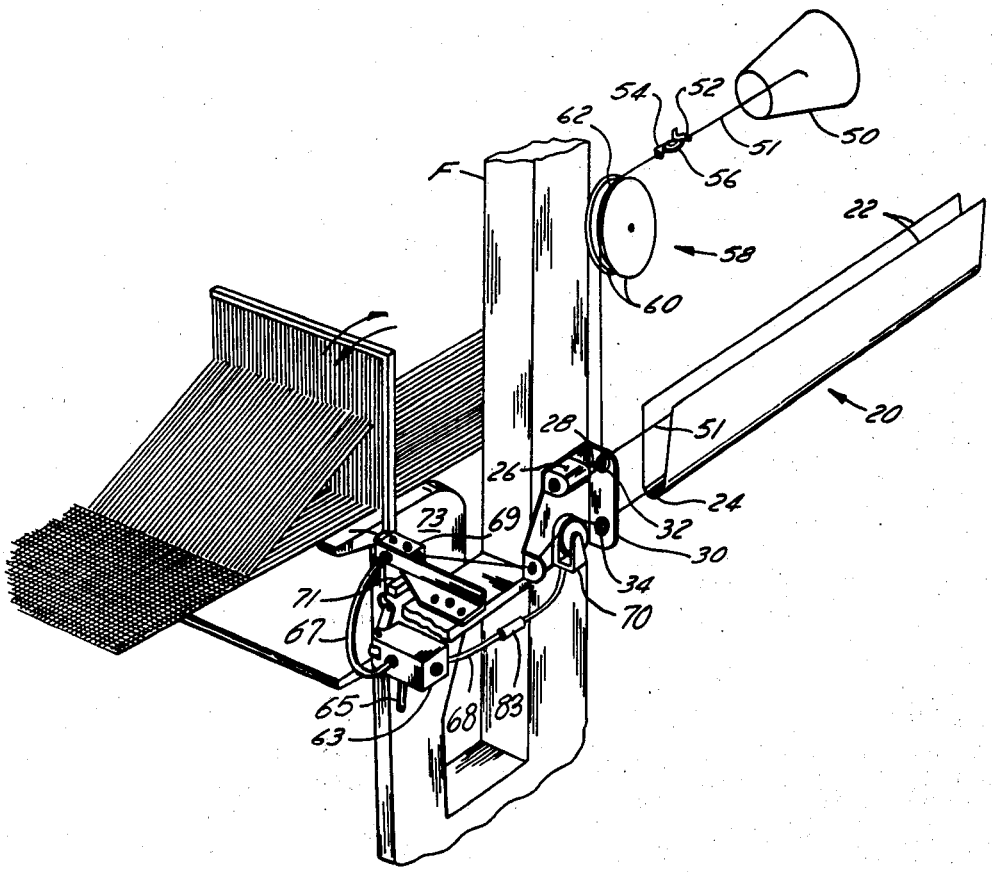
FIG. 1 is a perspective view of a portion of a modified loom incorporating one embodiment of the present invention relating to the water jet aspects of the present invention.

Referring now initially to FIG. 1, there is illustrated in that figure the weft filament storage device of the present invention and indicated generally by reference numeral 20. As shown, the storage device comprises an elongated generally U-shaped member having a pair of opposed side walls 22, each side wall forming a generally planar uninterrupted surface. In the embodiment illustrated, the side walls 22 taper slightly inwardly towards the bottom of the device 20 and are interconnected by means of a continuous bottom wall 24 of a length corresponding to the length of the side walls 22 whereby the side walls 22 and bottom wall 24 form a cavity therebetween. The ends of the storage device 20 are open as is the top between the upper portions of the side walls 22. The cavity formed by the side walls 22 and bottom wall 24 thus define a storage area for receiving a length of weft filament; the storage area being of a continuous elongated nature.

Operating in conjunction with the storage device is means to entrain a length of weft filament in an air current and to this end, there is provided a pneumatic control valve indicated by reference numeral 26 connected to a source of pressurized air (not shown), and which includes a nozzle 28 for projecting a jet of air.

A mounting plate 30 fixedly secures the valve 26 to a frame member F of the loom and at the same time, the mounting plate 30 includes a pair of apertures 32 and 34 therein. Both apertures form guiding "eyes" with the upper aperture being located in alignment with the nozzle 28 whereby the latter projects a jet of air through the eye 32. The nozzle 28 is spaced slightly from the eye 32 to provide a narrow gap for feeding of the weft filament to the storage device.

In constructing the weft filament storage device of the present invention, it has been found that the width across the device (that is between the walls 22), should not be greater than 10 times the opening of the aperture 32 through which the air flow passes. If a greater width is employed, it has been found that the airstream will cease to become a true airstream as such and accordingly, the width should be less than 10 times to maintain the weft filament in an untangled condition which the device achieves using the above circumstances. Typically, the eyelet may have an opening varying considerably from ten to twenty thousandths of an inch upwardly—normally, this eyelet will be in the order of one hundred thousandths of an inch, thus giving a maximum width of about 1 inch between the walls 22. Most preferably the width between the walls is between 4 to 10 times the opening of the eyelet 32.

The pressure utilized in the air jet may vary considerably but it is preferable to maintain this within the range of 5 to 25 pounds per square inch. At higher rates, the resistance exerted on the weft filament by the air flow may be too great to provide proper feeding of the weft filament across the shed, but this will depend on the type of filament. Obviously, it would be possible to go to higher pressures but for best performance, this is preferably maintained below 25 pounds per square inch. The pressure of the air will also vary depending on the filament strength so that with fragile filaments, lower air pressures will be utilized.

The length of the storage device should be equal to 50% of the length of the filament to be fed across the shed—most preferably, the filament does not extend beyond the end of the storage device. If the filament did extend beyond the edge, the filament would be free-floating in air and in addition to looping or twisting, entanglement with the sides of the storage device could occur.

The overall system of the present invention includes a source of weft filament or yarn material indicated generally by reference numeral 50, which is usually in the form of a spindle or bobbin of weft filament material. The bobbin 50 may be mounted by any suitable means to the loom. A continuous length of weft filament material, indicated by reference numeral 51, is withdrawn from the bobbin 50 in a continuous length. Depending on how the filamentary material 51 is withdrawn from bobbin 50, one or more sets of guides 52 and 54 may be employed for guiding the filamentary material in its path of travel to the storage system—the location and nature of such guides being according to conventional expedients with suitable mounting means for positioning the guide where appropriate. The filamentary material is passed through a thread tensioning device 54—again such devices being well known in the yarn art. Preferably, such thread tensioning means are employed between the source of the filamentary material and a measuring device (described hereinafter) for the purposes of feeding the weft filament under continuous tension to provide constant measurements for the filamentary material.

A measuring device indicated generally by reference numeral 58, preferably mounted to a suitable frame member (not shown) of the loom, is provided for feeding a predetermined amount of filamentary material to the weft storage device. The measuring device may be any suitable device known by those skilled in this art or according to a preferred embodiment of the present invention, comprises a rotating drum having a pair of side walls 60 projecting above the surface 62 of the drum to provide a drum surface having a recess and about which one or more turns of the weft filament material are wrapped. The measuring drum 58 may be driven by any suitable means in conjunction with the speed of operation of the loom—or alternatively, the drum 58 may be driven in synchronization with the drive of the loom and to this end, an appropriate drive system may be connected to the drive system of the loom. A number of turns of the filamentary material may be wrapped about the drum 58 and depending on the number of revolutions of the drum, a corresponding amount of material will be dispensed for the subsequent operation. It is also desirable to mount a guiding finger 62 in operative relationship to the drum 58 for separating the filamentary material 51 on the surface of the drum.

The weft inserting and gripping device illustrated in FIGS. 1 through 3 will now be described. To this end, there is provided a one-way trip valve 63 having an inlet 65 connected in operative relationship to a supply of a fluid under pressure (not shown) and a pair of outlets 67 and 68 connected to a nozzle 69 and a gripping device indicated generally by reference numeral 70. Gripping device 70 is interposed (not shown) between storage device 20 and a nozzle 11.

The valve 63 is actuated by a lobe 71 fixedly secured on the driving reed arm 73 which in turn is attached to the reed 74 each time the reed is moved to a fully open position. On its return stroke, the valve will not be actuated. Screw adjustments by means of screw 75 are provided for adjusting the timing and duration.

The gripping device includes a housing 76 containing a relatively small cylindrical chamber 77 having a piston 78 therein. Exteriorly, a portion of the piston 78 includes a gripping flange 79 adapted to be generally tightly pressed against the wall surface 80 of the housing 76 by means of a spring 81 supported on a bracket 82.

A check valve 83 is located upstream from the chamber 77 and in communication with the valve 63. The chamber 77 is connected in operative relationship to a control needle valve 84 via a conduit 85, with an exhaust port 86 in operative communication with the valve 84. The weft yarn filament 51 is passed between the gripping flange 79 and the wall surface 80 of the housing. The chamber 77 with the piston therein, as illustrated in the drawings, is only exemplary of the type of components that can be used and other shapes, movable seals or fluid actuators may likewise be used.

Figure 2:
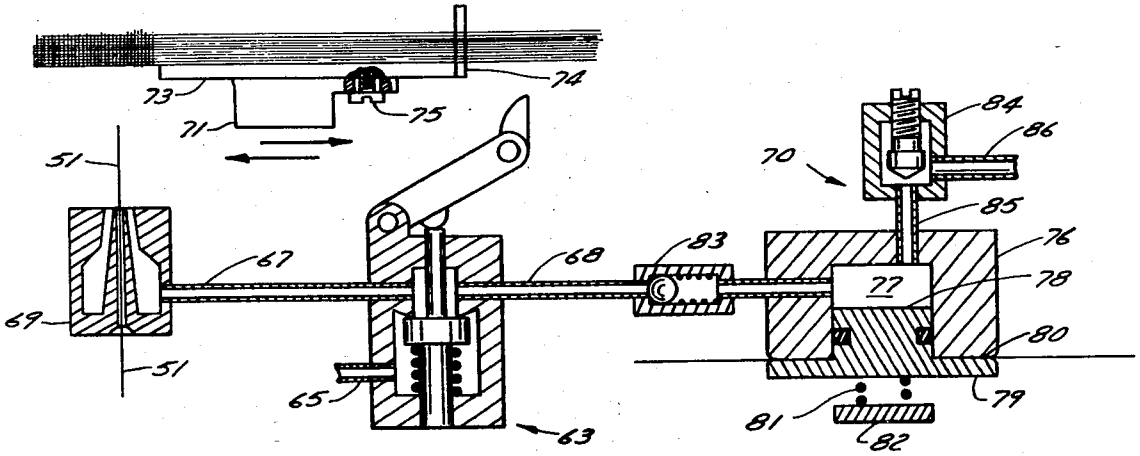
FIG. 2 is a schematic diagram showing the components of the water jet embodiment of FIG. 1.
Figure 3:
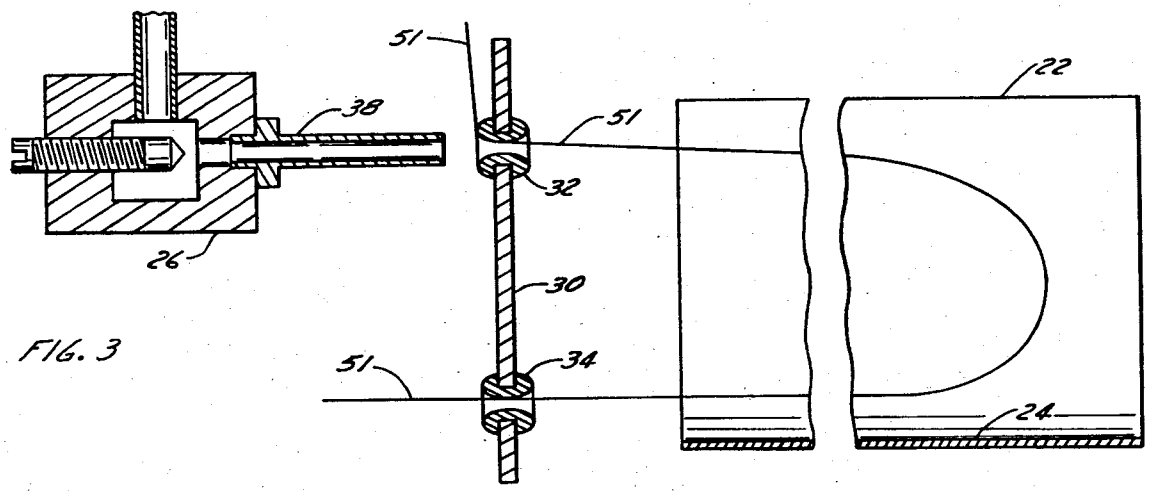
FIG. 3 is a similar view relating to the feeding system for feeding a weft filament and showing the storage device.
Figure 4:
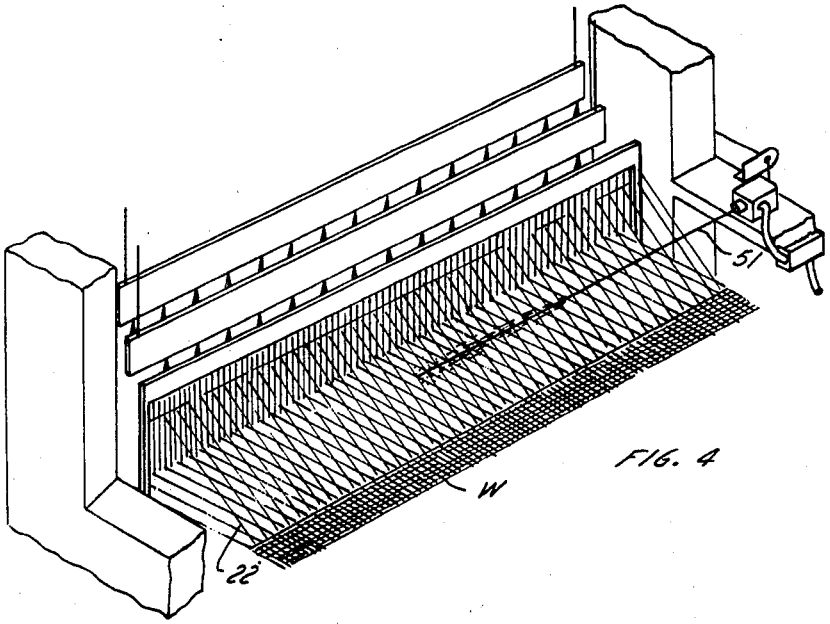
FIG. 4 is a perspective view of a portion of a loom incorporating the improved weft filament feeding means of the present invention.
Figure 5:
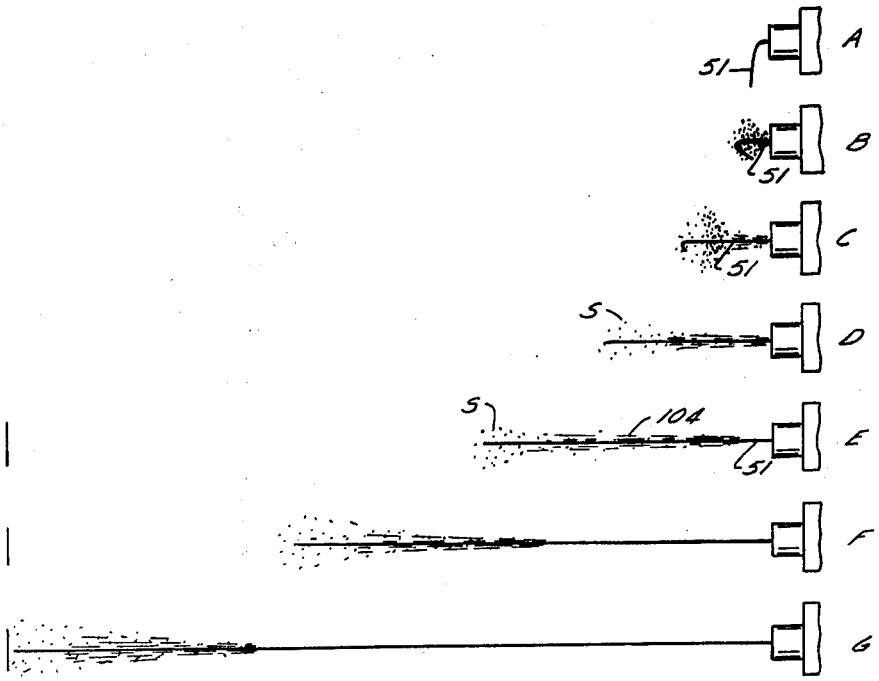
FIG. 5 illustrates the progressive motion of the weft filament as it is fed across the loom relative to the water carrier.

Referring now to FIGS. 4 and 5, the loom of the present invention is shown and includes the arrangement of FIGS. 1 through 3. In FIG. 4, the weft filament, indicated by reference numeral 51 is shown as being advanced through a portion of its length of travel across the shed through nozzle 11 and for explanatory purposes, reference may be had to FIG. 5 to better illustrate the principle of the present invention according to that embodiment thereof. More particularly, the weft filament is shown in FIG. 5, at the top, in a "stationary" position prior to the charge of fluid or water being released to propel and carry the weft filament and as is seen, the weft filament includes a leading end portion which, due to its own weight, forms a "tail." The length of the tail per se is not critical and may vary so that the portion of the filament 51 projecting from the nozzle can thus be very short or in the order of 0.5 to 2 inches or so. Upon the commencement of the cycle, a charge of water is released through the nozzle containing the filament, which due to friction, engages the filament, propels and carries the same across the shed as shown in FIG. 4. At the initial stage of the water or liquid being released from the nozzle, the leading charge or portion of the water, upon discharge from the nozzle, is broken up into droplets due to air resistance and thus, in FIG. 5B, forms a "spray" as shown therein. As will also be noted from FIG. 5B, the leading "tail" commences to "straighten out" due to engagement of the same with the charge of water and referring to FIG. 5C, the tail is in a generally straight or linear configuration with the balance of the filament 51 when the charge of water following the initial "spray" or "bulbous" configuration forms a generally linear charge enveloping the filament. Thus, as shown in FIG. 5C, the sheath of water following the initial spray is carrying and propelling the filament 51 in a generally linear configuration.

FIG. 5D illustrates the projection of the filament with the water carrier again during initial phases of the propelling across the shed and at this point, the leading tail is in a substantially straight configuration with the initial bulbous spray, indicated by reference letter S, being dispersed in a greater length along the filament followed by a generally conforming sheath of water.

In FIG. 5E, upon cessation of the charge of water, it will be seen that the water forms a generally cylindrical sheath about the filament indicated by reference numeral 104. The initial spray is still travelling in a generally horizontal pattern with the filament and the latter is continuing on a generally linear plane between the warp filaments 22 in the shed. The charge of water, now terminated, and referring to FIGS. 5F and 5G, is effective to carry the initial portion of the filament 51 across the shed completely and at the same time, to pull the balance of the filament 51 through the shed. As the charge of water progresses across the shed, divergence begins to take place but the amount of water is still sufficient to propel, and carry, the filament 51 through to the other side of the shed located opposite the point at which the filament was fed. FIG. 5G shows the leading edge of the filament in a position at the terminal end of its path of travel, to be engaged by suitable means such as those described hereinafter.

As will be seen from FIGS. 5A through 5G, and in accordance with a feature of the present invention, the charge of water is sufficient to initially engage the filament 51, form an envelope or sheath thereabout, and which envelope or sheath carries the leading end of the filament 51 while pulling the trailing end of the filament 51 across the shed. Thus, only the initial portion of the filament 51 is surrounded by the water charge.

In practice, the amount of water in the water charge should be sufficient to provide a water charge corresponding to 20 to 80% of the length of the filament, as measured across the shed. At higher amounts, the stream of water will have adverse effects on the filament by virtue of the initial or leading portion of the water charge slowing down due to air resistance while the trailing portion of the water charge will tend to "push" into the leading portion of the water charge and thus cause improper filament laying. Preferably, the amount of water charge is sufficient to provide 25 to 60% of the length of the filament with a sheath of water (as measured from the leading end of the filament) and most desirably between 30 to 45%. At these ranges, excellent filament lay-down has been obtained.

One of the prime advantages of the present invention is the fact that the process and apparatus can operate using relatively low pressure water systems—e.g., between 45 to 70 pounds per square inch. The amount of water pressure will actually depend on several factors including the type of filamentary material, the filament diameter, the width of the shed across which the filament must travel and the like. In some cases, it is possible to utilize up to 125 to 200 pounds per square inch of water pressure for larger diameter filaments but bearing in mind the fact that the water charge is only applied to the initial portions of the filament. In some cases, it may be desirable to include additives to the water charge to make the water adhere better to the filament—i.e., the resistance of the filament to movement by the water sheath or charge is reduced. Such additives may be typical of those known in the art for that purpose.

In utilizing the process and apparatus of the present invention, the volume of water dispersed can vary depending on several factors including the denier of the filaments, etc. Typically, the volume of water is between 0.6 cc per pick up to approximately 2 cc per pick, and most desirably between 0.8 cc to 1.5 cc per pick. Satisfactory results have been found utilizing 0.8 cc to 1.2 cc per pick.

As will be noted from the above description, the process of the present invention utilizes a water charge to pull the thread across the shed. As such, this has been found to provide proper lay-down of the filament and overcomes the problems associated with the prior art proposals which use continuous water jets to surround a filament as it is traversing totally the width of the shed.

Referring now to FIGS. 6 and 7, illustrating a further embodiment of the present invention, there is illustrated a typical conventional loom (FIG. 6) which may be converted according to this invention to a water jet system (as shown in FIG. 7). In FIG. 6, those parts which are associated with a conventional loom, and which are included in the modified loom of the present invention in FIG. 7, are shown in broken lines while those parts which are removed, according to this embodiment, are shown in solid lines in FIG. 6. Such conventional looms are well known to those skilled in the art and reference will only be made to those components which designate the key components for modification or removal according to the present invention. Thus, reference numeral 200 designates the parallel motion components which include a pick arm 202, a strap 204, a picker stick 206, the pick shaft 208, a pick cam 210, shuttle supply means 212, and a warp stop detector 214. The right hand lay parts 216, operatively associated with the picker stick, the shuttle 218, the center fork filling motion device 220, the lay beam 222, the filling cam 224, the pick cam 226, the latter pair of components operating in conjunction with the filling linkage 228, the knock-off rod 230, the left hand lay parts indicated generally by reference numeral 232, are further components of a typical conventional system. In a like manner, the single fork filler 238, the push-rod 240 and the pick shaft 242, together with the crank shaft 244 are further conventional components. Each of these components, according to this embodiment of the invention, are removed from the conventional apparatus and such components may be removed by conventional disassembly means. As such, therefore, the removal of these components shown in FIG. 6, thus eliminates from the conventional fly shuttle loom, the filling system of the conventional loom, the bobbin of thread, the pick motion, the parallel motion, the filling motion and the complete lay motion. Such components are not required in the water jet system of the present invention.

Referring now to FIG. 7, the modified conventional system of FIG. 6 is illustrated but including the components of the present invention to result in a modified loom suitable for weft filling using the water jet system. To this end, a trough or other like suitable water retaining means 250 is mounted to the frame of the apparatus through suitable frame members and associated with the trough are means to receive and retain the leading end of a weft filament. Such means, according to a preferred embodiment, includes a vacuum system having a mouth portion 252 connected to a means for creating a vacuum (not shown) through a conduit 254. In this manner, upon projection of a weft filament across the shed, the leading edge is engaged, when in proximity to the vacuum system, and retained for permitting subsequent steps to be carried out in the weaving operation. A further cam 256 is added to the cam shaft to drive the lay beam. Also mounted to the apparatus is a pair of edge cutters indicated generally by reference numeral 256 adapted to trim the edges of the woven fabric. These devices may be any suitable device for this purpose and such devices are well known by those skilled in the art. Such devices include mechanical or electrical heat cutters, etc.

The conversion system of the present invention also employs selvaging means and such means are illustrated in FIG. 7 and indicated generally by reference numeral 262. Such selvaging means are preferably of the type disclosed and claimed in copending application Ser. No. 786,596, filed Apr. 11, 1977. In its broader context, the conversion of the conventional system to the water jet system of the present invention may employ any suitable selvaging means for that purpose although in the preferred embodiment, such selvaging means are those of the copending application application referred to above.

Still further, as shown in FIG. 7, the components of FIGS. 1 to 3 are included for feeding a weft filament to finish conversion of a conventional system to the water jet system.

The process of the present invention may be applied to natural and synthetic filaments with the denier ranging over a considerable range—e.g., 50 denier to 300 denier or even greater, with satisfactory results being obtained. The present invention has many advantages over the prior art proposals including the fact that the lay of the weft filament can be accurately controlled since the filament is basically being pulled in a relatively straight line. This in turn provides better products. In addition, limited amounts of water are employed thus resulting in a greater economy of operation—and further, the components of the present invention are relatively simple to construct as compared to other prior art proposals. The present invention utilizes more economical and fewer parts and provides the additional advantage that with such parts, conversion of existing looms to water jet looms of the present invention can be readily obtained.

It will be understood that various modifications may be made to the above without departing from the spirit and scope of the invention.

I claim:

1. An apparatus for advancing a weft filament, in a weaving apparatus, across warp filaments comprising a source of pressurized liquid, nozzle means for projecting said source of pressurized liquid in a stream across said shed, means for supplying a length of weft filament having a free leading end and in operative relationship to said source of pressurized liquid, whereby said stream of pressurized liquid is adapted to engage said leading end of said filament, means for actuating said source of pressurized liquid to provide a predetermined amount of pressurized liquid in the form of a stream directed across a shed, and means for interrupting the flow of said stream of pressurized liquid before said weft filament traverses the width of the shed, wherein said means for actuating the source of pressurized liquid and the means for interrupting the flow of the stream of pressurized liquid comprises a liquid supply assembly, said liquid supply assembly comprising a conduit leading from said source of pressurized liquid, a valve having a liquid inlet port, first and second liquid outlet ports, and a liquid passageway intermediate said liquid inlet port and said liquid outlet ports, said liquid inlet port being connected to said conduit, and a valve piston mounted in said liquid passageway, said valve piston being adapted to open and close said liquid passageway in conjunction with the motion of the weaving apparatus, said first liquid outlet port being connected to said nozzle, and said second liquid outlet port being in communication with a weft filament gripping means.

2. An apparatus as defined in claim 1, wherein said source of pressurized liquid comprises a source of pressurized water having a pressure of at least 45 pounds per square inch.

3. An apparatus as defined in claim 1, wherein said source of pressurized liquid comprises a source of pressurized water having a pressure of between 45 to 70 pounds per square inch.

4. An apparatus as defined in claim 1, wherein said apparatus includes nozzle means for forming said pressurized liquid into a stream, said nozzle means being adapted to dispense said pressurized liquid in an amount of from about 0.6 cc per pick to 2 cc per pick.

5. An apparatus as defined in claim 1, wherein said apparatus includes means for interrupting the flow of liquid at a point where the stream is between about 20 to 80% across the width of the shed.

6. An apparatus as defined in claim 1, wherein said apparatus includes means for interrupting the flow of liquid at a point where the stream is between about 25 to 60% across the width of the shed.

7. An apparatus as defined in claim 1, wherein said gripping means comprises first fixed means forming a fixed non-movable surface, second movable means mounted in operative relationship to said first fixed means whereby said second movable means is adapted to be brought into and out of filament engaging relationship with said first fixed means with said first and second means together forming a filament engaging and gripping member, and means for causing said second movable means to be brought into and out of engagement with said first fixed means, said last-mentioned means comprising a liquid inlet port adapted to receive and transmit a flow of liquid therethrough, a liquid outlet port in communication with said inlet port through a passageway between said inlet and outlet ports, and means for intermittently introducing a flow of liquid into said inlet port, whereby said flow of liquid is effective to actuate said second movable means into a filament engaging means.

* * * * *